US005770286A

United States Patent [19]

Sorkin

[11] Patent Number: 5,770,286

[45] Date of Patent: Jun. 23, 1998

[54] CORROSION INHIBITOR RETAINING SEAL

[76] Inventor: Felix L. Sorkin, P.O. Box 1503, Stafford, Tex. 77477

[21] Appl. No.: 630,444

[22] Filed: Apr. 10, 1996

[51] Int. Cl.[6] ..... E04C 5/08

[52] U.S. Cl. ..... 428/36.9; 428/36.91; 428/36.92; 428/43; 52/100; 52/223.13; 52/223.14; 52/301; 138/96 R

[58] Field of Search ..... 428/35.7, 36.9, 428/36.92, 36.91, 43, 131, 156; 52/100, 301, 223.13, 223.14; 138/96 R, 96 T

[56] References Cited

U.S. PATENT DOCUMENTS

| | | | |
|---|---|---|---|
| 4,773,198 | 9/1988 | Reinhardt | 52/223.13 |
| 5,072,558 | 12/1991 | Sorkin et al. | 52/223.13 |
| 5,263,291 | 11/1993 | Knight | 52/223.13 |
| 5,271,199 | 12/1993 | Northern | 52/223.13 |
| 5,440,842 | 8/1995 | Sorkin | 52/223.13 |
| 5,630,301 | 5/1997 | Sieg | 52/223.13 |

*Primary Examiner*—Rena L. Dye
*Attorney, Agent, or Firm*—Harrison & Egbert

[57] ABSTRACT

A seal for use on a tubular member in post-tension construction including a cap having a tubular body and a surface extending across the of the tubular body, and a corrosion-resistant material contained within the interior area of the cap. The surface closes an end of the tubular body. The surface has a frangible area formed thereon. The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

6 Claims, 3 Drawing Sheets

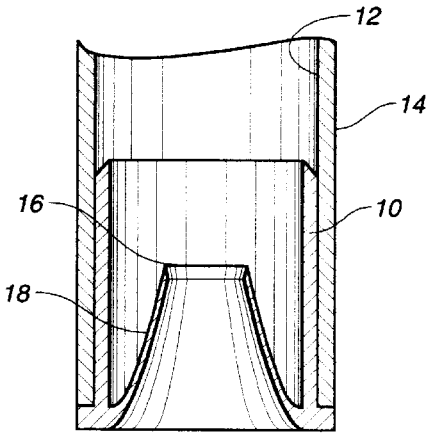
FIG. 1
PRIOR ART
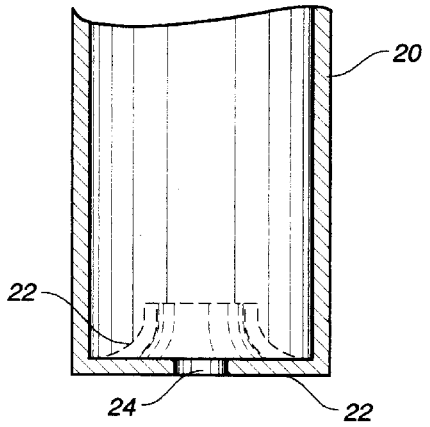
FIG. 2
PRIOR ART
FIG. 3
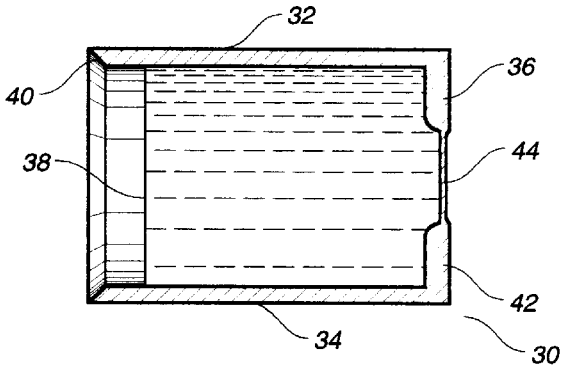
FIG. 4
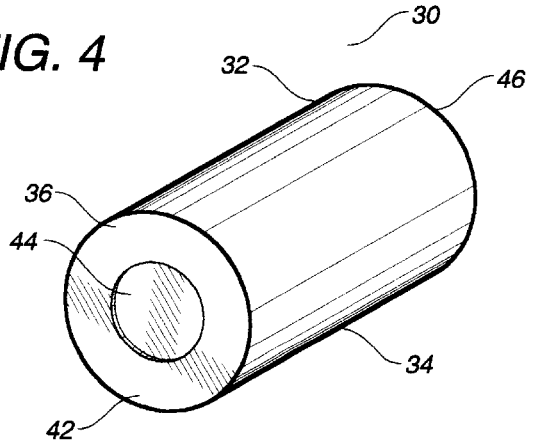
FIG. 5
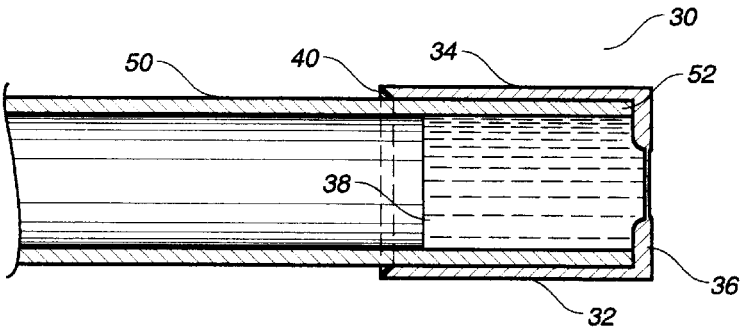

CORROSION INHIBITOR RETAINING SEAL

TECHNICAL FIELD

The present invention relates to seals. More particularly, the present invention relates to seals which are used in post-tensioning systems.

BACKGROUND ART

In conventional post-tensioning systems, a tendon is affixed, in tension, onto an anchor. In conventional practice, the tendon has a polymeric coating or sheathing extending over the exterior of the tendon. When it is necessary to tension the tendon, a portion of the sheathing is removed from the exterior of the tendon so as to allow the tensioning apparatus to appropriately stress the end of the tendon. When a portion of the sheathing is removed, the exposed end of the tendon can be corroded by the elements. As a result, corrosion will occur over time unless appropriate steps are taken so as to prevent corrosion from occurring. This corrosion can result in damage or deterioration in the post-tension system.

An initial attempt to prevent such corrosion was the practice of extending a tubular member from the end of the anchor over the exposed portion of the tendon. This tubular member is often known as a "transition piece" or a "trombone slide". In normal practice, a seal is formed or placed at an end of the tubular member opposite the anchor. The seal is intended to create a water-tight seal between the outer diameter of the sheathing of the tendon and the inner diameter of the transition piece.

FIGS. 1 and 2 show examples, from the prior art, in which a seal is used so as to enclose the interior of the transition piece. For example, in FIG. 1, an elastomeric seal 10 is affixed to the inner surface 12 of the transition piece 14. The seal 10 includes an interior aperture 16 which allows the tendon, and associated sheathing, to extend therethrough. The surface 18 of the seal 10 is intended to form a liquid-tight seal with the outer diameter of the sheathing.

FIG. 2 shows an alternative configuration of a prior art system for the sealing of the interior area of a transition member 20. The transition member 20 includes an end surface 22 which has a hole 24 formed therein. The end surface 22 is sufficiently flexible and pliable so as to conform with the outer diameter of a tendon extending therethrough. In practice, the end of the tendon is inserted through the hole 24 such that the end surface 22 will deform (as shown in broken lines in FIG. 2) so as to form a liquid-tight seal with the outer diameter of the sheathing of the tendon.

In both of the prior art examples of FIGS. 1 and 2, an appropriate liquid-tight seal is formed between the outer diameter of the sheathing and the inner diameter of the transition piece. In normal practice, the interior of the transition piece is filled with air in the void between the outer diameter of the sheathing or tendon and the inner diameter of the transition piece.

Unfortunately, extensive use of such transition pieces and such seals has shown that problems still remain. Under certain circumstances, water will form or accumulate on the interior of the transition piece. As a result, the seals will "trap" the water within the interior of the transition piece. Although efforts can be taken so as to avoid water intrusion into the interior of the transition piece, actual practice has indicated that it is virtually impossible to keep the interior of the transition piece free of water under all circumstances.

For example, water may accumulate on the interior of the transition piece while the transition piece is stored at the work site or transported to the work site. As a result, a need has been developed so as to assure that water, and other adverse elements, are not contained within and will not intrude into the interior of the transition piece.

One practice that has occurred has been the introduction of a rust-inhibiting grease into the interior void between the tendon and the transition piece. The injection of grease is a very effective process for the removal of air and/or water from the interior of the transition piece. One technique for introducing such grease is known as the "ice pick" method. This practice simply involves using an ice pick to punch a hole in the plastic sleeve and, using a cone-pointed grease gun similar to that used to grease the sprocket on a chain saw, grease is injected into the sleeve. As a result, the grease will displace water from the interior of the void between the transition piece and the exterior of the tendon. Unfortunately, this technique tends to destroy the integrity of the sheathing and is a very complicated procedure. In particular, it involves various apparatus (such as the grease gun) which require proper use at the job site. Additionally, it requires that the relatively unskilled construction labor take the appropriate steps, under all circumstances, so as to assure that these voids are completely filled. This can be a very time consuming and costly activity. In many circumstances, the use of an ice pick on the body of the transition piece can destroy the integrity of the transition piece. Ultimately, liquids can intrude into the interior of the transition piece, over time, through the hole formed by the ice pick.

It is an object of the present invention to provide a seal which can provide a corrosion inhibiting material to the interior of a transition piece.

It is another object of the present invention to provide a post-tensioning construction system in which the void between the exterior diameter of the tendon and the inner diameter of the transition piece is filled with a corrosion inhibiting chemical.

It is a further object of the present invention to provide a seal for a transition piece which is easy to install and easy to use.

It is a further object of the present invention to provide a post-tension construction system that eliminates water from the voids on the interior of the transition piece.

It is still another object of the present invention to provide a seal which requires no tools for installation.

It is still a further object of the present invention to provide a seal that is easy to manufacture and relatively inexpensive.

These and other objects and advantages of the present invention will become apparent from a reading of the attached specification and appended claims.

SUMMARY OF THE INVENTION

The present invention is a seal for use on a tubular member in a post-tension construction system that comprises a cap having a tubular body and a frangible surface extending across an interior of the tubular body and a corrosion-inhibiting material received within the interior of the cap. The frangible surface closes one end of the tubular body. The surface has a area formed thereon.

In the present invention, the tubular body of the cap has an inner diameter approximately the same as an outer diameter of the tubular member (or transition piece). The tubular body of the cap has a tapered edge opposite the frangible surface so as to facilitate the installation of the cap onto the tubular member. The frangible surface extends transverse to a longitudinal axis of the tubular body at one end of the tubular body. The frangible area of the frangible surface has a thickness which is less than a thickness of a non-frangible remainder of the surface. The cap is integrally formed of a polymeric material. In an alternative embodiment of the present invention, a membrane extends across the tubular body of the cap opposite the frangible surface. This membrane serves to contain the corrosion-inhibiting material between the membrane and the frangible surface.

In the present invention, the cap is slidably received over an end of the tubular member opposite the anchorage onto which the tubular member is attached. The end of the tubular member is in abutment with the closed frangible surface of the cap. The frangible surface includes a first non-frangible portion which extends inwardly from the tubular body across a portion of the end of the tubular member, and a frangible area extending from the non-frangible area across a remainder of the end of the tubular member.

The present invention is also a method of attaching a tendon to an anchorage of a post-tension anchor system which includes the steps of: (1) affixing a cap to an end of a tubular member; (2) attaching the opposite end of the tubular member to the anchorage; (3) passing the tendon through a frangible surface of the cap such that the frangible surface forms a seal with an outer diameter of the tendon; and (4) displacing the corrosion-resistant from the interior of the cap throughout a void between the outer diameter of the tendon and the inner diameter of the tubular member. The cap is filled with the corrosion-resistant material in a volume generally equal to a volume of the void in the tubular member.

BRIEF DESCRIPTION OF THE DRAWINGS

FIGS. 1 and 2 show two examples of prior art seals used on transition pieces in post-tension construction.

FIG. 3 is a cross-sectional view of the preferred embodiment of the present invention.

FIG. 4 is an end perspective view of the seal of the present invention.

FIG. 5 is a cross-sectional view showing the installation of the seal onto a tubular member.

DETAILED DESCRIPTION OF THE INVENTION

Figure 6:
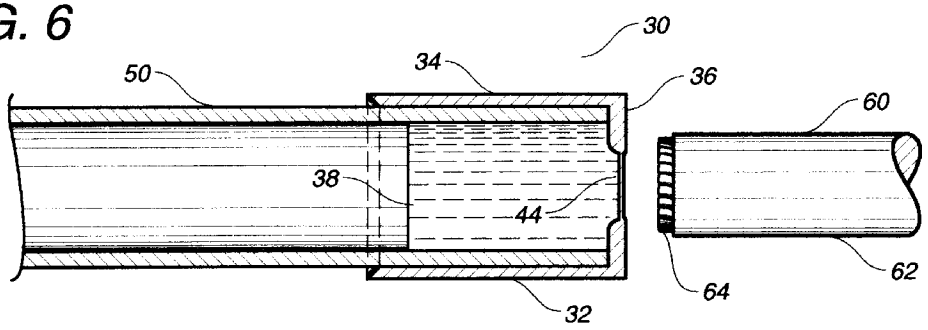
FIGS. 6 and 7 are cross-sectional views showing the installation of the present invention.

Referring to FIG. 3, there is shown at 30 the seal in accordance with the preferred embodiment of the present invention. As can be seen in FIG. 3, the seal 30 is a cap 32 having a tubular body 34 and a frangible surface 36 extending across the tubular body. The frangible surface 36 closes one end of the tubular body 34. A corrosion-inhibiting material 38 fills at least a portion of the volume of the interior of the cap 32. The tubular body 34 of the cap 32 has a tapered edge 40 opposite the frangible surface 36. The tapered edge 40 allows the cap 32 to be easily installed onto the end of a tubular member (to be described hereinafter).

As used herein, the term "corrosion-inhibiting material" refers to grease and rust-inhibiting chemicals in general.

In the present invention, frangible surface 36 extends across an end of the tubular body 34 generally transverse to the longitudinal axis of the tubular body 34. The frangible surface 36 includes a non-frangible area 42 which extends inwardly from the tubular body 34. A frangible area 44 is formed generally centrally of the non-frangible area 42. As used herein, the term "frangible" refers to tearable, breakable, puncturable, or displacable surfaces which allow entry into the interior of the cap 32. As shown in the preferred embodiment of the present invention, in FIG. 3, the frangible area 44 has a thickness which is less than the thickness of the non-frangible area 42. When a force is applied to the frangible area 44, it will break or tear so as to allow entry therethrough.

FIG. 4 shows the seal 30 of the present invention in a perspective view. In particular, it can be seen that the end surface 36 has a non-frangible area 42 and a frangible area 44 located generally centrally of the non-frangible area 42. The tubular body 44 extends from end 46 to the end surface 36. In the preferred embodiment of the present invention, the seal 30 is integrally formed of a polymeric material.

FIG. 5 illustrates how the seal 30 is affixed onto a transition piece 50 in a post-tension construction system. In particular, it can be seen that the tubular body 34 is slidably positioned over the outer diameter of the tubular member 50. The tapered edge 40 facilitates the ability to install the cap 32 onto an end of the tubular member 50. The end 52 of the tubular member 50 will abut the end surface 36 of the cap 32. When the seal 30 is installed onto the tubular member 50, in the manner shown in FIG. 5, the corrosion-resistant material 38 will extend into at least a portion of the interior of the tubular member 50. In the configuration shown in FIG. 5, the seal 30, along with the tubular member 50, are in a suitable condition for receiving the tendon of the post-tension construction system. As can be seen, the seal 30 can easily be installed on the tubular member 50 by simply sliding the seal 30 onto the end 52 of the tubular member 50.

FIG. 6 shows that a cable 60 is positioned in proximity to the end surface 36 of the seal 30. The cable 60 includes a sheathing 62 and a tendon 64 contained therein. The cable 60 has a diameter which is greater than the diameter of the frangible area 44 on the end surface 36.

Figure 7:
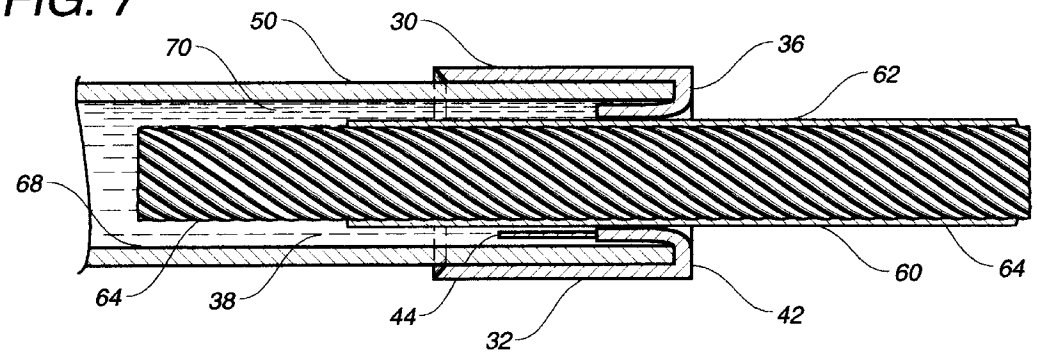

FIG. 7 shows the cable 60 as installed into the tubular member 50. As can be seen, the end of the cable 60 is pushed through the end surface 36 of the seal 30. When sufficient pressure is applied, the frangible area 44 will break so as to allow the cable 60 to pass therethrough. The non-frangible area 42 will deform as the cable 60 is passed therethrough. This deformation causes the non-frangible area 42 to form a liquid-tight seal with the outer diameter of the sheath 62 of the cable 60.

As can be seen in FIG. 7, as the cable 60 passes through the interior of the cap 32 and the tubular member 50, the corrosion-inhibiting material 38 on the interior of the cap 32 and the tubular member 50 is displaced. The corrosion-inhibiting material 38 will fill the voids between the outer diameter of the tendon 64 (with or without its sheathing 62) and the inner diameter 68 of the tubular member 50. So as to avoid any water accumulation in the void 70, a sufficient volume of corrosion-inhibiting material 38 should be initially introduced into the cap 32. The volume can be easily calculated by subtracting the outer diameter of the cable 60 from the inner diameter of the tubular member 50 and multiplying by the length of the tubular member 50. As a result, each of the seals 30 can be appropriately filled with a volume of corrosion-resistant material so as to fill the voids of various lengths of the transition piece 50. The displacement of the corrosion-resistant material 38 serves to cause any water accumulation on the interior of the tubular member 50 to be pushed outwardly through the opposite end of the tubular member 50. As a result, the present invention allows the interior of the tubular member 50 to be free of water. Additionally, the volume of air on the interior of the tubular member 50 is also minimized. The corrosion-resistant material 38 will also displace air from the interior of the tubular member 50.

Figure 8:
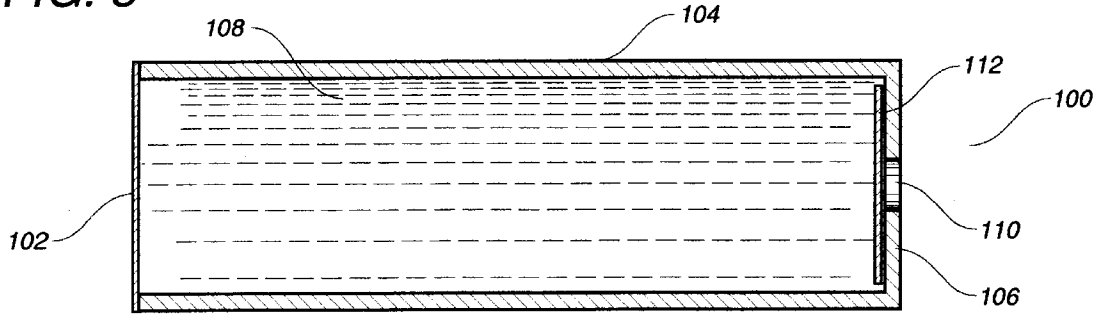
FIG. 8 is a cross-sectional view of an alternative embodiment of the present invention.

FIG. 8 shows an alternative embodiment of the present invention. In the alternative embodiment 100 of the present invention, a membrane 102 extends across an opposite end of the cap 104 from the end surface 106. As a result, the corrosion-resistant material 108 is retained within the interior of the cap 104 between the membrane 102 and the end surface 106. The membrane 102 is a very thin film of material which can be sealed onto the end of the cap 104.

FIG. 8 also shows an alternative embodiment of the present invention with respect to the end surface 106. In the embodiment of FIG. 8, the end surface 106 can include an opening 110. The opening 110 allows access to the interior of the cap 104. A disk 112 is juxtaposed against the interior of the end surface 106 so as to close the hole 110. When a tendon is introduced through the hole 110, the tendon will displace the disk 102 so as to allow the tendon to pass through the interior of the cap 104. The disk 110 can be angularly displaced onto a side wall of the tubular member or it can be pushed toward an opposite end of the tubular member 104. As used herein, the use of such a disk, or similar member, should be construed as an equivalent of the "frangible surface".

Figure 9:
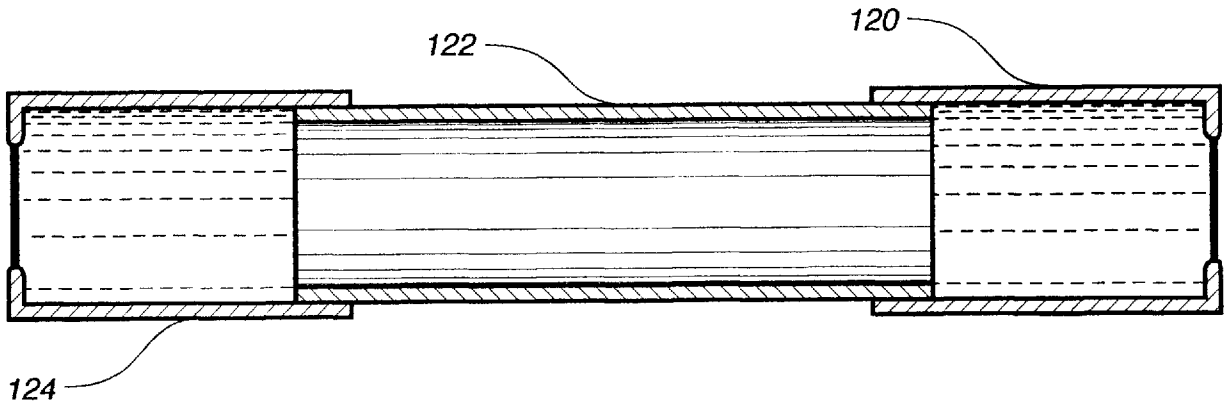
FIG. 9 is a cross-sectional view showing the seal as applied to both ends of the tubular member.

FIG. 9 shows the configuration of the present invention in which a cap 120 is affixed to one end of a tubular member 122 and another cap 124 is affixed to an opposite end of tubular member 122. Each of the caps 122 and 124 has a configuration similar to the caps described herein previously. These caps 122 and 124 serve as seals if it is necessary to place the tubular member 122 on a tendon and then slide it along the tendon.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A transition member for use on an anchorage of a post-tension construction system comprising:

a tubular member having a first end and a second end, said first end for attachment to the anchorage;

a cap affixed to said second end of said tubular member, said cap having a closed frangible surface extending across said second end of said tubular member; and a corrosion-resistant material positioned within said cap adjacent said closed frangible surface.

2. The transition member of claim 1, said cap slidably received over said second end of said tubular member, said second end of said tubular member being in abutment with said closed frangible surface.

3. The transition member of claim 2, said corrosion-resistant material filling a portion of an interior of said tubular member.

4. The transition member of claim 1, said cap having a tubular body extending around a portion of said tubular member, said closed frangible surface comprising:

a non-frangible area extending inwardly from said tubular body across a portion of said second end of said tubular member; and a frangible area extending centrally of said non-frangible area across a remainder of said second end of said tubular member.

5. The transition member of claim 4, said frangible area having a lesser thickness than said non-frangible area.

6. The transition member of claim 1, further comprising:

a sealing member affixed to said first end of said tubular member.

* * * * *